US010685640B2

(12) United States Patent
Farahbakhsh et al.

(10) Patent No.: US 10,685,640 B2
(45) Date of Patent: Jun. 16, 2020

(54) SYSTEMS AND METHODS FOR RECURSIVE NORM CALCULATION

(71) Applicant: Bose Corporation, Framingham, MA (US)

(72) Inventors: Siamak Farahbakhsh, Waltham, MA (US); Wade Torres, Attleboro, MA (US); Eric Bernstein, Cambridge, MA (US)

(73) Assignee: Bose Corporation, Framingham, MA (US)

( * ) Notice: Subject to any disclaimer, the term of this patent is extended or adjusted under 35 U.S.C. 154(b) by 36 days.

(21) Appl. No.: 16/176,892

(22) Filed: Oct. 31, 2018

(65) Prior Publication Data

US 2020/0135165 A1 Apr. 30, 2020

(51) Int. Cl.
*G10K 11/178* (2006.01)

(52) U.S. Cl.
CPC .. *G10K 11/17854* (2018.01); *G10K 11/17813* (2018.01); *G10K 11/17823* (2018.01); *G10K 11/17879* (2018.01); *G10K 2210/1282* (2013.01); *G10K 2210/3011* (2013.01); *G10K 2210/3012* (2013.01); *G10K 2210/3016* (2013.01); *G10K 2210/3026* (2013.01);
(Continued)

(58) Field of Classification Search
CPC ..... G10K 11/17854; G10K 11/17813; G10K 2210/3011; G10K 11/17879; G10K 2210/1282; G10K 2210/3012
USPC ..... 381/71.11, 71.1, 71.12
See application file for complete search history.

(56) References Cited

U.S. PATENT DOCUMENTS 7,545,859 B2 * 6/2009 Reichard ..... H04L 25/03133 333/18
2009/0012786 A1 1/2009 Zhang et al.
(Continued)

FOREIGN PATENT DOCUMENTS

WO 2013049376 4/2013

OTHER PUBLICATIONS

International Search Report and The Written Opinion of the International Searching Authority, International Application No. PCT/US2019/058765, pp. 1-14, dated Feb. 4, 2020.
(Continued)

*Primary Examiner* — Vivian C Chin
*Assistant Examiner* — Ubachukwu A Odunukwe
(74) *Attorney, Agent, or Firm* — Bond, Schoeneck & King, PLLC

(57) ABSTRACT

A noise-cancellation method, comprising the steps of: receiving a value from a noise sensor at a time step; storing the received value in a buffer, the buffer having a length, the buffer further storing a number of additional values, wherein an end value is removed from the buffer to accommodate the received value; providing a previously-computed result, wherein the previously-computed result represents the sum of the square of the values stored in the buffer at a previous time step; adding a square of the received value to the previously-computed result and subtracting a square of the end value from the sum of the received value and the previously computed value in order to yield a newly-computed result and updating a plurality of coefficients of an adaptive filter according to, in part, the value of the newly-computed result.

20 Claims, 9 Drawing Sheets

(52) U.S. Cl.
CPC ..... *G10K 2210/3027* (2013.01); *G10K 2210/3031* (2013.01)

(56) References Cited

U.S. PATENT DOCUMENTS

| | | | | |
|---|---|---|---|---|
| 2016/0314778 | A1* | 10/2016 | Christoph | G10K 11/178 |
| 2017/0162205 | A1 | 6/2017 | Melvin et al. | |

OTHER PUBLICATIONS

Anonymous: "Running total—Wikipedia", Wikipedia, Aug. 19, 2018 (Aug. 19, 2018), pp. 1-2, XP055661187, Internet Retrieved from Internet: URL: https://en.wikipedia.org/w/index.php?titl=Running_total&oldid=855615611 [retrieved on Jan. 23, 2020].

* cited by examiner

SYSTEMS AND METHODS FOR RECURSIVE NORM CALCULATION

BACKGROUND

The present disclosure generally relates to system and methods for recursively calculating a norm and for periodically correcting the value of the norm to account for rounding errors.

SUMMARY

All examples and features mentioned below can be combined in any technically possible way.

According to an aspect a noise-cancellation method, includes the steps of: receiving a value from a noise sensor at a time step; storing the received value in a buffer, the buffer having a length, the buffer further storing a number of additional values, wherein an end value is removed from the buffer to accommodate the received value; providing a previously-computed result, wherein the previously-computed result represents the sum of the square of the values stored in the buffer at a previous time step; performing one of: (i) adding a square of the received value to the previously-computed result and subtracting a square of the end value from the sum of the received value and the previously computed value in order to yield a newly-computed result; or (ii) subtracting a square of the end value from the previously-computed result and adding a square of the received value to the result of subtracting the square of the end value from the previously computed result in order to yield a newly-computed result; and updating a plurality of coefficients of an adaptive filter according to, in part, the value of the newly-computed result; generating with the adaptive filter a noise-cancelling signal using the updated plurality of coefficients; and providing the noise-cancellation signal to an actuator for transduction of a noise-cancellation audio signal based on the noise-cancellation signal, the noise-cancellation audio signal destructively interfering with an undesired noise signal in a noise-cancellation zone.

In an example, the method further includes the steps of finding a square root of the newly-computed result to yield a norm calculation, wherein the step of updating the plurality of coefficients is based in part on the norm calculation.

In an example, the method further includes the steps of adding the square of the received value to a running sum of squared received values to yield a current running sum of squared received values; and replacing the newly-computed result with the current running sum of squared received values if the current running sum of squared received values is the result of summing together a number of squared values equal to the length of the buffer.

In an example, the method further includes the step of setting the current running sum of squared received values to zero after replacing the newly-computed result with the current running sum of square received values.

In an example, the method further includes the step of the, during the time step, summing the square of the values stored in the buffer to yield a corrective value and replacing the newly-computed result with the corrective value.

In an embodiment, the received value comprises a plurality of received values and the end value comprises a plurality of end values, wherein the number of the plurality of received values and the number of the plurality of end values is the same.

In an embodiment, steps (i) and (ii) are performed before the step of storing the value in the buffer.

According to another aspect, program code is stored on a non-transitory storage medium that, when executed by a processor, includes the steps of: receiving a value from a noise sensor at a time step; storing the received value in a buffer, the buffer having a length, the buffer further storing a number of additional values, wherein an end value is removed from the buffer to accommodate the received value; providing a previously-computed result, wherein the previously-computed result represents the sum of the square of the values stored in the buffer at a previous time step; performing one of: (i) adding a square of the received value to the previously-computed result and subtracting a square of the end value from the sum of the received value and the previously computed value in order to yield a newly-computed result; or (ii) subtracting a square of the end value from the previously-computed result and adding a square of the received value to the result of subtracting the square of the end value from the previously computed result in order to yield a newly-computed result; and updating a plurality of coefficients of an adaptive filter according to, in part, the value of the newly-computed result; generating with the adaptive filter a noise-cancelling signal using the updated plurality of coefficients; and outputting the noise-cancellation signal to an actuator for transduction of a noise-cancellation audio signal based on the noise-cancellation signal, the noise-cancellation audio signal destructively interfering with an undesired noise signal in a noise-cancellation zone.

In an example, the program code further includes the step of finding a square root of the newly-computed result to yield a norm calculation, wherein the step of updating the plurality of coefficients is based in part on the norm calculation.

In an example, the program code further includes the steps of adding the square of the received value to a running sum of squared received values to yield a current running sum of squared received values; and replacing the newly-computed result with the current running sum of squared received values if the current running sum of squared received values is the result of summing together a number of squared values equal to the length of the buffer In an example, the program code further includes the step of setting the current running sum of squared received values to zero after replacing the newly-computed result with the current running sum of square received values.

In an example, the program code further includes the step of, during the time step, summing the square of the values stored in the buffer to yield a corrective value and replacing the newly-computed result with the corrective value.

In an embodiment, the received value comprises a plurality of received values and the end value comprises a plurality of end values, wherein the number of the plurality of received values and the number of the plurality of end values is the same.

In an embodiment, steps (i) and (ii) are performed before the step of storing the value in the buffer.

According to another aspect a noise-cancellation system includes: a noise-cancellation filter including a plurality of coefficients configured to generate a noise-cancellation signal based on the plurality of coefficients; an actuator configured to receive the noise-cancellation signal and to transduce a noise-cancellation audio signal based on the noise-cancellation signal, the noise-cancellation signal destructively interfering with an undesired noise signal in a noise-cancellation zone; an error sensor configured to output an error sensor signal having a value at a time step; the error sensor signal being representative of residual undesired noise in the noise-cancellation zone; an adaptive processing module configured to: store the value in a buffer, the buffer having a length, the buffer further storing a number of additional values, wherein an end value is removed from the buffer to accommodate the value; provide a previously-computed result, wherein the previously-computed result represents the sum of the square of the values stored in the buffer at a previous time step; perform one of: (i) adding a square of the received value to the previously-computed result and subtracting a square of the end value from the sum of the received value and the previously computed value in order to yield a newly-computed result; or (ii) subtracting a square of the end value from the previously-computed result and adding a square of the value to the result of subtracting the square of the end value from the previously computed result in order to yield a newly-computed result; and update the plurality of coefficients of the adaptive filter according to, in part, the value of the newly-computed result; wherein the noise-cancellation filter is configured to generate an updated noise-cancelling signal based on the updated plurality of coefficients, the actuator transducing an updated noise-cancellation audio signal based on the updated noise-cancellation signal, the updated noise-cancellation audio signal destructively interfering with an undesired noise signal in a noise-cancellation zone.

In an example, the adaptive processing module is further configured to find a square root of the newly-computed result to yield a norm calculation, wherein updating the plurality of coefficients is based in part on the norm calculation.

In an example, the adaptive processing module is further configured to: add the square of the received value to a running sum of squared received values to yield a current running sum of squared received values; and replace the newly-computed result with the current running sum of squared received values if the current running sum of squared received values is the result of summing together a number of squared values equal to the length of the buffer.

In an example, the adaptive processing module is further configured to set the current running sum of squared received values to zero after replacing the newly-computed result with the current running sum of square received values.

In an example, the adaptive processing module is further configured to: during the time step, sum the square of the values stored in the buffer to yield a corrective value and replace the newly-computed result with the corrective value.

In an embodiment, the received value comprises a plurality of values and the end value comprises a plurality of end values, wherein the number of the plurality of values and the number of the plurality of end values is the same.

The details of one or more implementations are set forth in the accompanying drawings and the description below. Other features, objects, and advantages will be apparent from the description and the drawings, and from the claims.

DETAILED DESCRIPTION

Various embodiments described herein are directed to an improved method for calculating a norm. According to the improved method, a norm is calculated recursively, using a part of the norm calculated in a previous time step. Because the norm is recursively calculated, rounding errors may begin accumulating over time. Accordingly, a correction algorithm, running in parallel or at discrete intervals, may correct the value of the norm to a value without rounding errors, or at least to a value with lower rounding errors.

Figure 1:
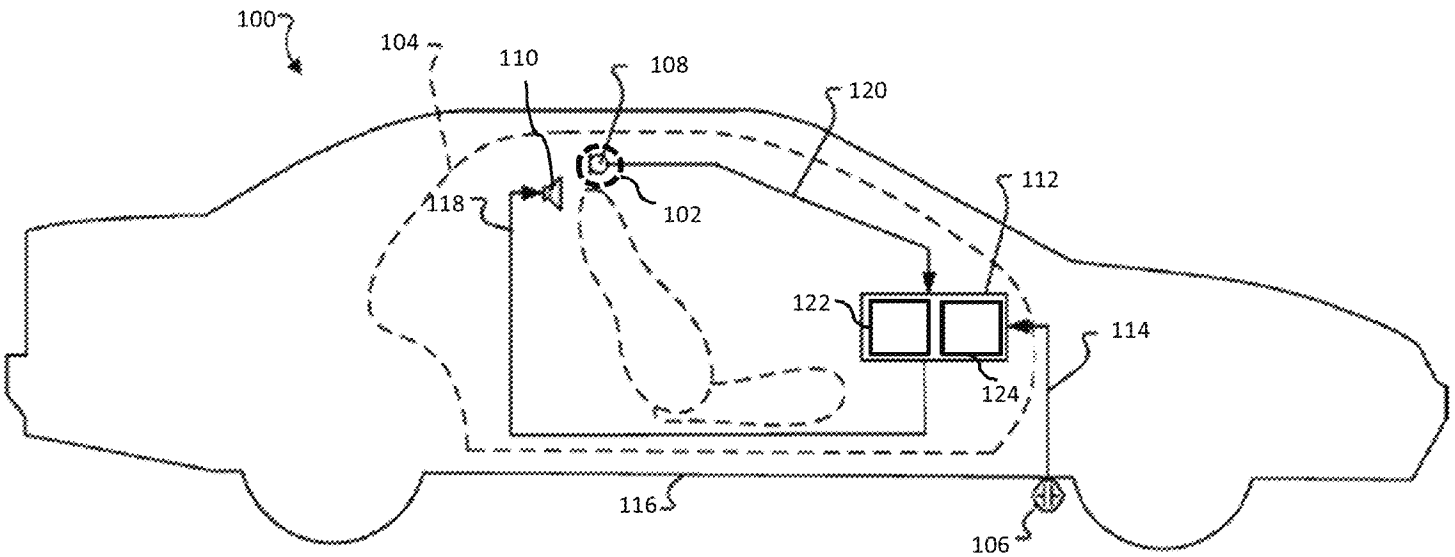
FIG. 1 is a schematic of a noise-cancellation system according to an embodiment.

FIG. 1 is a schematic view of an example noise-cancellation system 100 which may perform a norm calculation. Noise-cancellation system 100 may be configured to destructively interfere with undesired sound in at least one cancellation zone 102 within a predefined volume 104 such as a vehicle cabin. At a high level, an embodiment of noise-cancellation system 100 may include a noise sensor 106, an error sensor 108, an actuator 110, and a controller 112.

In an embodiment, noise sensor 106 is configured to generate noise signal(s) 114 representative of the undesired sound, or a source of the undesired sound, within predefined volume 104. For example, as shown in FIG. 1, noise sensor 106 may be an accelerometer mounted to and configured to detect vibrations transmitted through a vehicle structure 116. Vibrations transmitted through the vehicle structure 116 are transduced by the structure into undesired sound in the vehicle cabin (perceived as road noise), thus an accelerometer mounted to the structure provides a signal representative of the undesired sound Actuator 110 may, for example, be speakers distributed in discrete locations about the perimeter of the predefined volume. In an example, four or more speakers may be disposed within a vehicle cabin, each of the four speakers being located within a respective door of the vehicle and configured to project sound into the vehicle cabin. In alternate embodiments, speakers may be located within a headrest, or elsewhere in the vehicle cabin.

A noise-cancellation signal 118 may be generated by controller 112 and provided to one or more speakers in the predefined volume, which transduce the noise-cancellation signal 118 to acoustic energy (i.e., sound waves). The acoustic energy produced as a result of noise-cancellation signal 118 is approximately 180° out of phase with—and thus destructively interferes with—the undesired sound within the cancellation zone 102. The combination of sound waves generated from the noise-cancellation signal 118 and the undesired noise in the predefined volume results in cancellation of the undesired noise, as perceived by a listener in a cancellation zone.

Because noise-cancellation cannot be equal throughout the entire predefined volume, noise-cancellation system 100 is configured to create the greatest noise cancellation within one or more predefined cancellation zones 102 with the predefined volume. The noise-cancellation within the cancellation zones may effect a reduction in undesired sound by approximately 3 dB or more (although in varying embodiments, different amounts of noise-cancellation may occur). Furthermore, the noise-cancellation may cancel sounds in a range of frequencies, such as frequencies less than approximately 350 Hz (although other ranges are possible).

Error sensor 108, disposed within the predefined volume, generates an error sensor signal 120 based on detection of residual noise resulting from the combination of the sound waves generated from the noise-cancellation signal 118 and the undesired sound in the cancellation zone. The error sensor signal 120 is provided to controller 112 as feedback, error sensor signal 120 representing residual noise uncancelled by the noise-cancellation signal. Error sensors 108 may be, for example, at least one microphone mounted within a vehicle cabin (e.g., in the roof, headrests, pillars, or elsewhere within the cabin).

It should be noted that the cancellation zone(s) may be positioned remotely from error sensor 108. In this case, the error sensor signal 120 may be filtered to represent an estimate of the residual noise in the cancellation zone(s). In either case, the error signal will be understood to represent residual undesired noise in the cancellation zone.

In an embodiment, controller 112 may comprise a non-transitory storage medium 122 and processor 124. In an embodiment, non-transitory storage medium 122 may store program code that, when executed by processor 124, implements the various filters and algorithms described below. Controller 112 may be implemented in hardware and/or software. For example, controller may be implemented by a SHARC floating-point DSP processor, but it should be understood that controller may be implemented by any other processor, FPGA, ASIC, or other suitable hardware.

Figure 2:
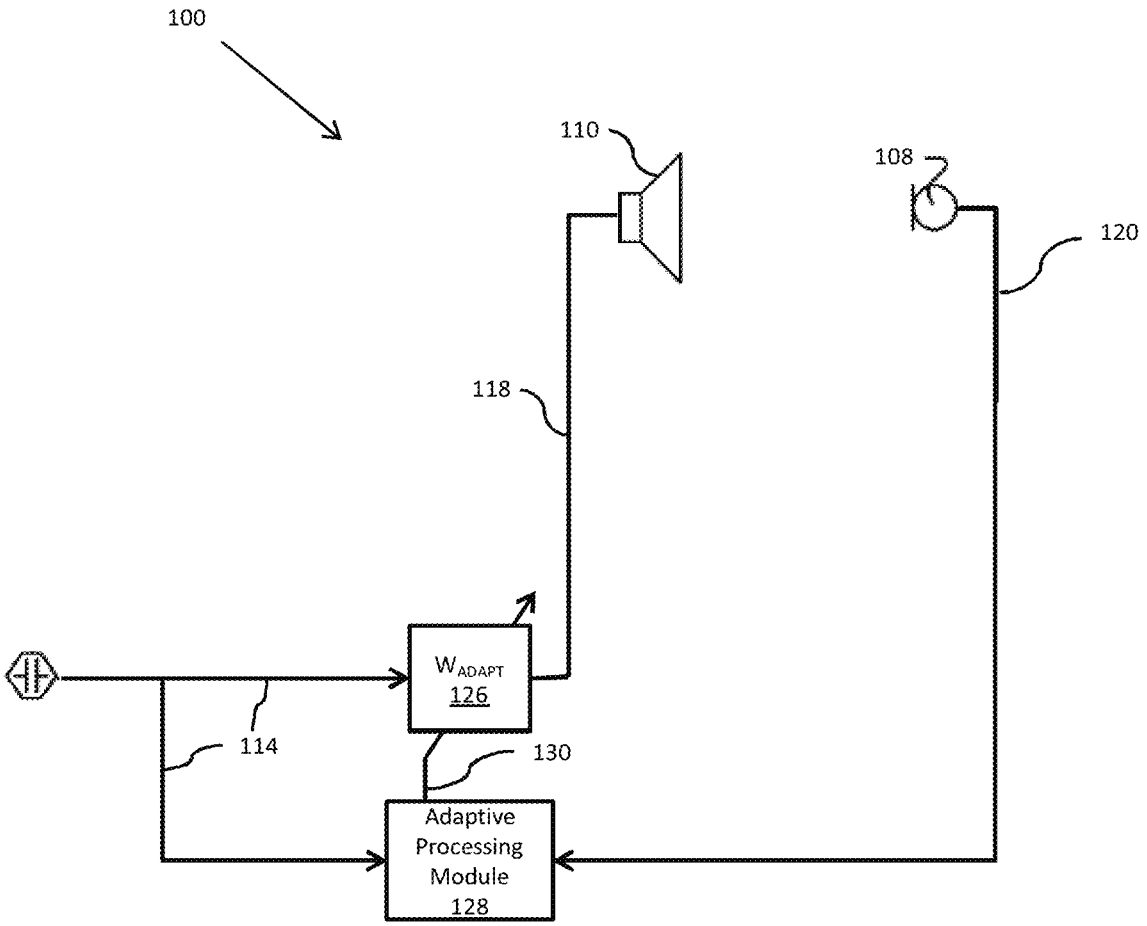
FIG. 2 is a schematic of a noise-cancellation system according to an embodiment.

Turning to FIG. 2, there is shown a block diagram of an embodiment of noise-cancellation system 100, including a plurality of filters implemented by controller 112. As shown, controller may define a control system including $W_{adapt}$ filter 126 and an adaptive processing module 128.

$W_{adapt}$ filter 126 is configured to receive the noise signal 114 of noise sensor 106 and to generate noise-cancellation signal 118. Noise-cancellation signal 118, as described above, is input to actuator 110 where it is transduced into the noise-cancellation audio signal that destructively interferes with the undesired sound in the predefined cancellation zone 102. $W_{adapt}$ filter 126 may be implemented as any suitable linear filter, such as a multi-input multi-output (MIMO) finite impulse response (FIR) filter. $W_{adapt}$ filter 126 employs a set of coefficients which define the noise-cancellation signal 118 and which may be adjusted to adapt to changing behavior of the nonlinear vehicle response to road input (or to other inputs in non-vehicular noise-cancellation contexts).

The adjustments to the coefficients may be performed by an adaptive processing module 128, which receives as inputs the error sensor signal 120 and the noise signal 114 and, using those inputs, generates a filter update signal 130. The filter update signal 130 is an update to the filter coefficients implemented in $W_{adapt}$ filter 126. The noise-cancellation signal 118 produced by the updated $W_{adapt}$ filter 126 will minimize error signal 120, and, consequently, the undesired noise in the cancellation zone.

The coefficients of $W_{adapt}$ filter 126 at time step n may be updated according to the following equation:

$$W_{adapt}[n+1] = W_{adapt}[n] + \mu(\tilde{T}'_{de} * e)\frac{x}{\|x\|_2} \tag{1}$$

where $\tilde{T}_{de}$ is an estimate of the physical transfer function between actuator 110 and the noise-cancellation zone 102, $\tilde{T}'_{de}$ is the conjugate transpose of $\tilde{T}_{de}$, is the error signal, and x is the output signal of noise sensor 106. In the update equation, the output signal x of noise sensor is divided by the norm of x, represented as $\|x\|_2$.

Figure 3:
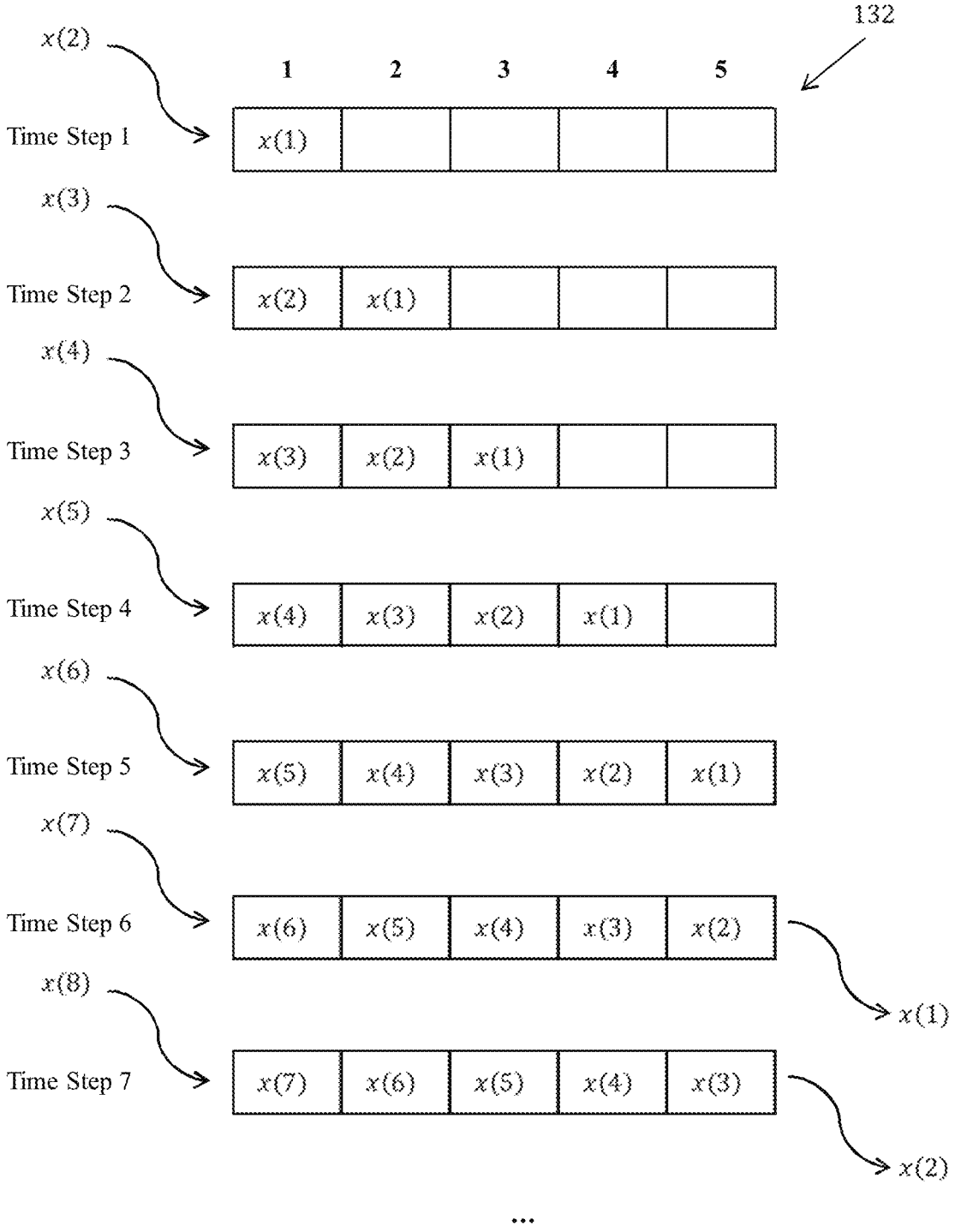
FIG. 3 is a diagrammatic representation of a buffer according to an embodiment.

The norm of output signal x may be calculated by the adaptive processing module 128 (FIG. 2) based on a plurality of noise-sensor samples (e.g., 100 samples, although other suitable buffer lengths may be used stored in a buffer 132, shown in FIG. 3, received at the current and previous time steps. Buffer 132 may be, for example, a first-in-first-out (FIFO) buffer—that is to say, once the buffer has reached capacity, the oldest sample is removed each time a new sample is added. Assuming a new value is received each time step, a new value will be added to buffer 132 and the oldest value will be removed from buffer 132. Buffer 132 thus represents a shifting window of values including the newest value and a number N of previous values.

This process is shown in FIG. 3 which depicts an example buffer 132 with an example length of five values. The values are represented as x(n), where n is the time step at which the respective value was received. Thus, x(1) was received at Time Step 1, x(2) was received at Time Step 2, and so on. Each time a new value is received, it is placed at the front of buffer 132 and the remaining values of buffer 132 are shifted by one place toward the back of the buffer 132. Thus, at Time Step 2, x(2) is placed at the front of buffer 132 and x(1), received earlier, is shifted back by one place. Likewise, at Time Step 3, x(3) is placed at the front of buffer 132 and x(2) and x(1) are shifted back. Once buffer 132 has reached capacity, the oldest value is removed from buffer 132 to accommodate the newest value. For example, at Time Step 6, x(6) is placed at the front of buffer 132 while x(1) is removed from buffer 132 to accommodate x(6). Similarly, at Time Step 7, new value x(7) is placed at the front of buffer while the oldest value x(2) is removed.

Figure 4:
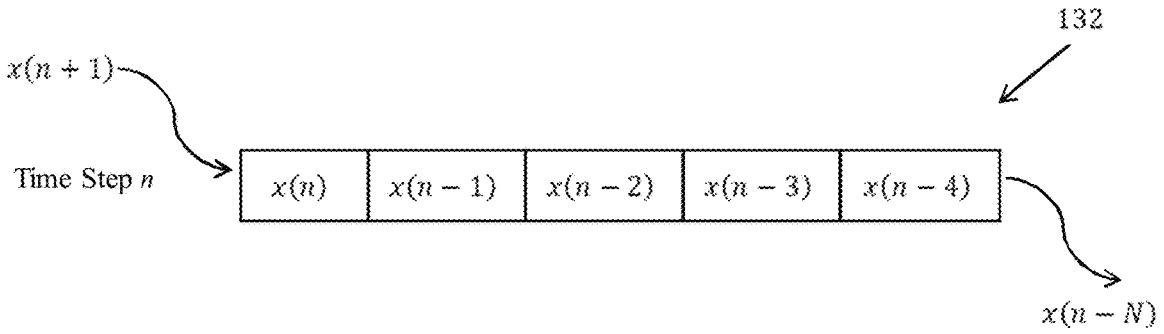
FIG. 4 is a diagrammatic representation of a buffer according to an embodiment.

The process depicted in FIG. 3 is depicted more abstractly in FIG. 4, showing buffer 132 at some arbitrary time step n. As shown, the front of buffer 132 contains the newest received value x(n) while each subsequent place in the buffer contains samples received in order from newest to oldest (thus, the remaining places of buffer 132 respectively contain x(n−1), x(n−2), x(n−3), and x(n−4)). The value to be added during the next time step, x(n+1), is shown entering to the left of buffer 132 and the value removed during the last time step, x(n−N), is shown to exiting to the right of buffer 132.

It should be understood that designations of the front of the buffer and back of the buffer are arbitrary designations to refer to the place of the buffer that stores the newest value and oldest value, respectively. It should also be understood that the linear portrayal of buffer 132 in FIGS. 4-6 and 9 is only one way to represent the implementation of buffer 132 and does not necessarily represent the positioning of registers within memory, which may or may not be contiguous.

As part of the typical norm-calculation algorithm, each sample stored in buffer 132 is squared and then summed with the remaining squared values (a result that is represented in this disclosure as (A(n))). The square root of A(n) is then taken to yield a norm-calculation result y(n). This may be represented by the following equation:

$$y(n) = \sqrt{\sum_{i=0}^{N-1} x^2(n-i)} \tag{2}$$

where N is the length of buffer 132, and x(n) is the input value at time step n. For example, using the second time step, equation (2) may be expanded as follows:

$$y(2)=\sqrt{x^2(1)+x^2(2)} \tag{3}$$

Similarly, at the tenth time step (assuming a buffer length of five), equation (2) may be expanded as follows:

$$y(10)=\sqrt{x^2(6)+x^2(7)+x^2(8)+x^2(9)+x^2(10)} \tag{4}$$

Of course, the buffer length of five is merely used as an example, and, as mentioned above, any suitable buffer length may be used.

Figure 5:
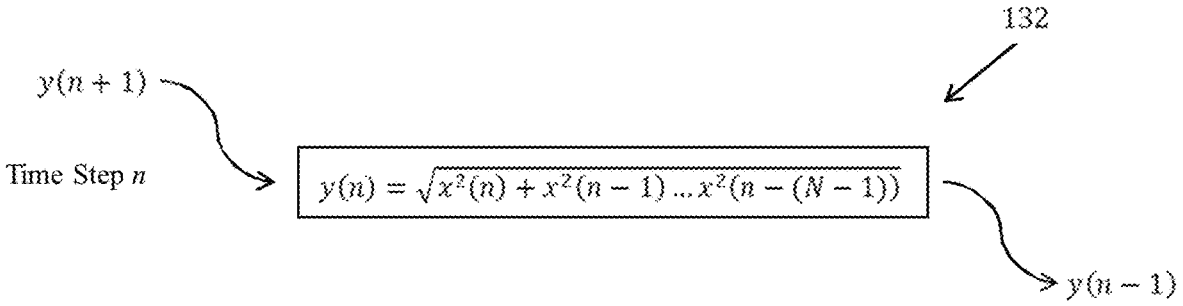
FIG. 5 is a diagrammatic representation of a norm calculation according to an embodiment.

The process of finding a new result y(n) according to equation (2) is depicted in FIG. 5. At time step n the value of y(n) is computed according to:

$$y(n)=\sqrt{x^2(n)+x^2(n-1)\ldots x^2(n-(N-1))} \tag{5}$$

(which is simply equation (2) expanded), by squaring and summing each value stored in buffer 132 from the newest value $x^2(n)$ to the oldest value $x^2(n-(N-1))$.

But squaring and summing each value every time a new sample is inputted to the buffer is computationally inefficient. In the 100-sample buffer example, this computation would require squaring 100 independent values and summing the resulting squared values—a minimum of 199 operations—each time a new sample is received.

Accordingly, instead of squaring and summing each value, result y(n) may be calculated recursively—that is, y(n) may be calculated using part of the most recently computed result y(n−1) according to the following equation:

$$A(n)=A(n-1)+x^2(n)-x^2(n-N) \tag{6}$$

where $$y(n)=\sqrt{A(n)} \tag{7}$$

and A(0)=0. Stated more plainly, the squared and summed result of a buffer (i.e., A(n)) that includes newly-received value x (n) may be calculated by adding the squared result of newly-received value x(n) (i.e, $x^2(n)$) and subtracting the square of the value that was stored at the end of the buffer before the inclusion of x(n) (i.e., $x^2(n-N)$). The value of A(n) before the first time step is set to zero and thus $A(n)=x^2(n)$ at the first time step. Once the value of A (n) is determined, y(n) may be calculated as the square root of A(n) according to equation (7).

Figure 6:
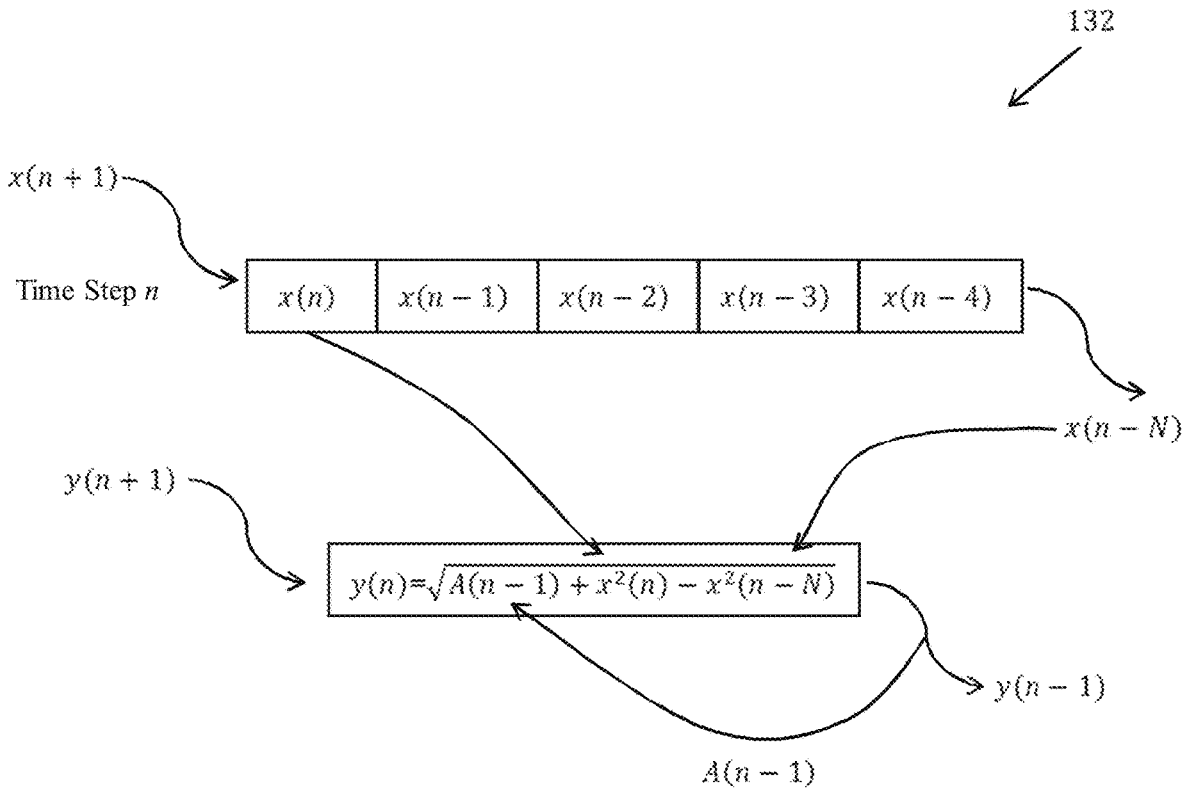
FIG. 6 is a diagrammatic representation of a recursive norm calculation according to an embodiment.

This process is shown diagrammatically in FIG. 6. As shown, the value of y(n) is determined according to equations (6) and (7), which itself is, in part, recursively based on the value of A(n) from the previous time step (A(n−1)), shown in FIG. 6 as being taken from the removed previous result y(n−1).

It should be understood that this method will require storing the value previously removed from the back of buffer 132, for at least one time step. In order to store this value, buffer 132 may be extended by one place. Alternatively, the removed value may be stored elsewhere in memory. Regardless, for the purposes of this discloses the last place of buffer will be considered to be the last space storing x(n−(N−1)), even though buffer 132 may be extended to include at least one other value, such as x(n−N).

Figure 7:
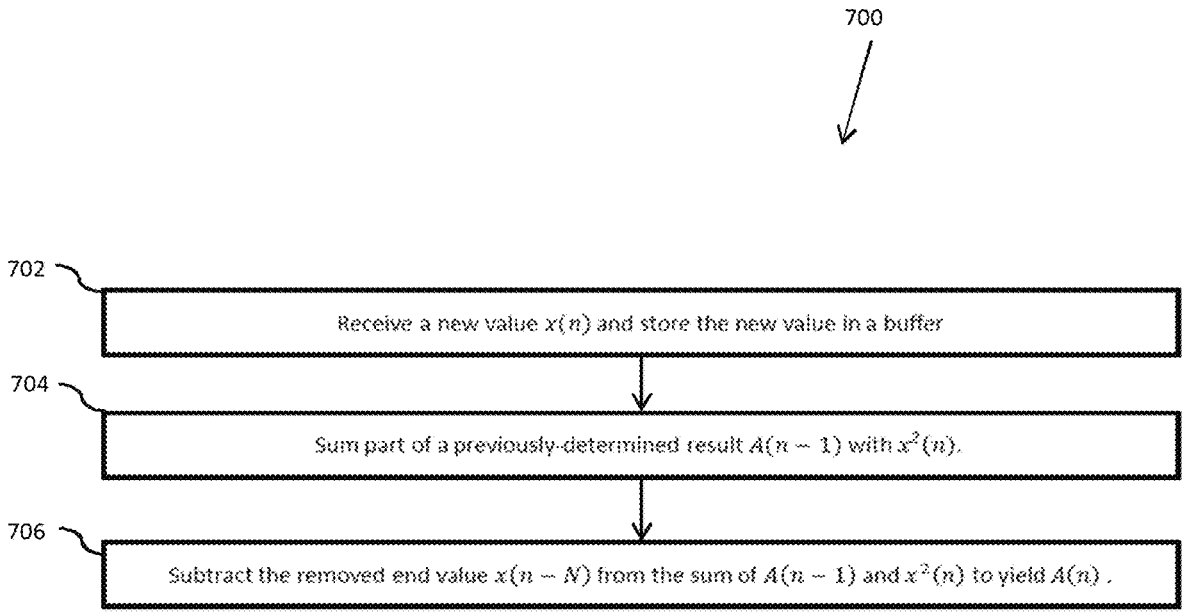
FIG. 7 is a flowchart of a recursive norm calculation method according to an embodiment.

An example of the recursive norm calculation is shown as method 700 in FIG. 7. Method 700 may be implemented, for example, by adaptive processing module 128, which, in turn, is implemented by controller 112. As mentioned above, method 700 may be implemented by controller 112 and may be stored as program code in non-transitory storage medium 122, although purely hardware or firmware implementations are possible. At step 702, a new value x(n) is received and stored at the first place of buffer 132, while each remaining value is stepped down one place, resulting in end value x(n−N) being removed from buffer 132 but retained in memory. (As mentioned above, x(n−N) may actually be stored in one extra place of buffer 132, or stored elsewhere.) At step 704, part of a previously-determined result A(n−1), which represents the result of summing and squaring the values stored in buffer before the inclusion of x(n) and the removal of x(n−N) at Time Step n, is summed with $x^2(n)$. At step 704, the removed end value x(n−N) is then subtracted from the sum of A(n−1) and $x^2(n)$.

Of course, steps 702-706 may be ordered in any suitable way. For example, the value of x(n) may be first squared and added to previously-determined result A(n−1) before it is added to first place of buffer 132 (e.g., x(n) may be temporarily stored elsewhere while the calculation takes place and then added to buffer 132). Similarly, the square of x(n−N) may be subtracted from A(n−1) before that result is added to the square of x(n). In other words, steps 702-706 may be ordered in any way, so long as they function to add and subtract the proper values in a given time step or to otherwise implement equation (6).

At this point, it is also worth mentioning two special cases of method 700: (i) the first value added, x(1), and (ii) all other values added before buffer 132 is totally filled. As mentioned above, the first value added has no previous result to which it may be added and the value of A(0) is taken to be zero. Accordingly, the first result y(1) is simply x(n) (the value of $A(1)=x^2(1)$ and so this value may still be calculated and stored for use in the following step). The next special case, which consists of all newly-received values after x(1) and before x(N) will be computed normally, but no value is subtracted as part of the calculation (alternately, a zero is subtracted) since all values x(n)=0 for n≤0.

Furthermore, it should be understood that multiple values may be received during a single time step. In that instance all received values may be stored in the buffer, squared and summed with the previously-computed result. All values displaced by the storage of additional values may be similar squared and subtracted from the previously-computed result. It should also be understood that the norm need not be calculated for each time step. If the norm is not calculated for each time step, all new values received since that the last norm calculation may be added to the previously-determined result and all values removed may be likewise squared and subtracted. Alternatively, only a portion of values may be added or subtracted, but that will come at the cost of accuracy.

Compared to performing the calculation of equation (5), the recursive norm calculation requires only three operations to calculate A(n), and is thus much more computationally efficient.

Figure 8:
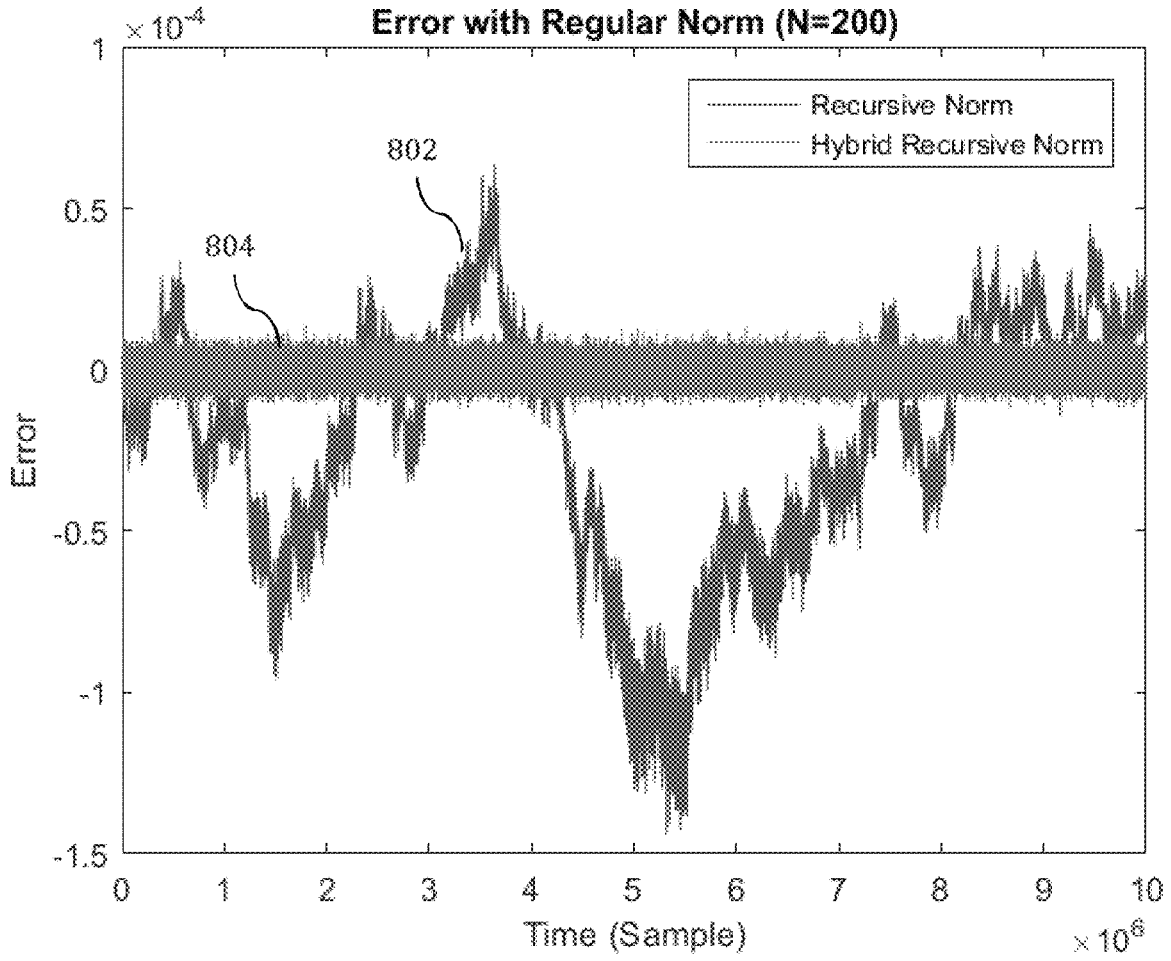
FIG. 8 is a graph showing errors using a recursive norm calculation method and a hybrid recursive norm calculation method.
Figure 9:
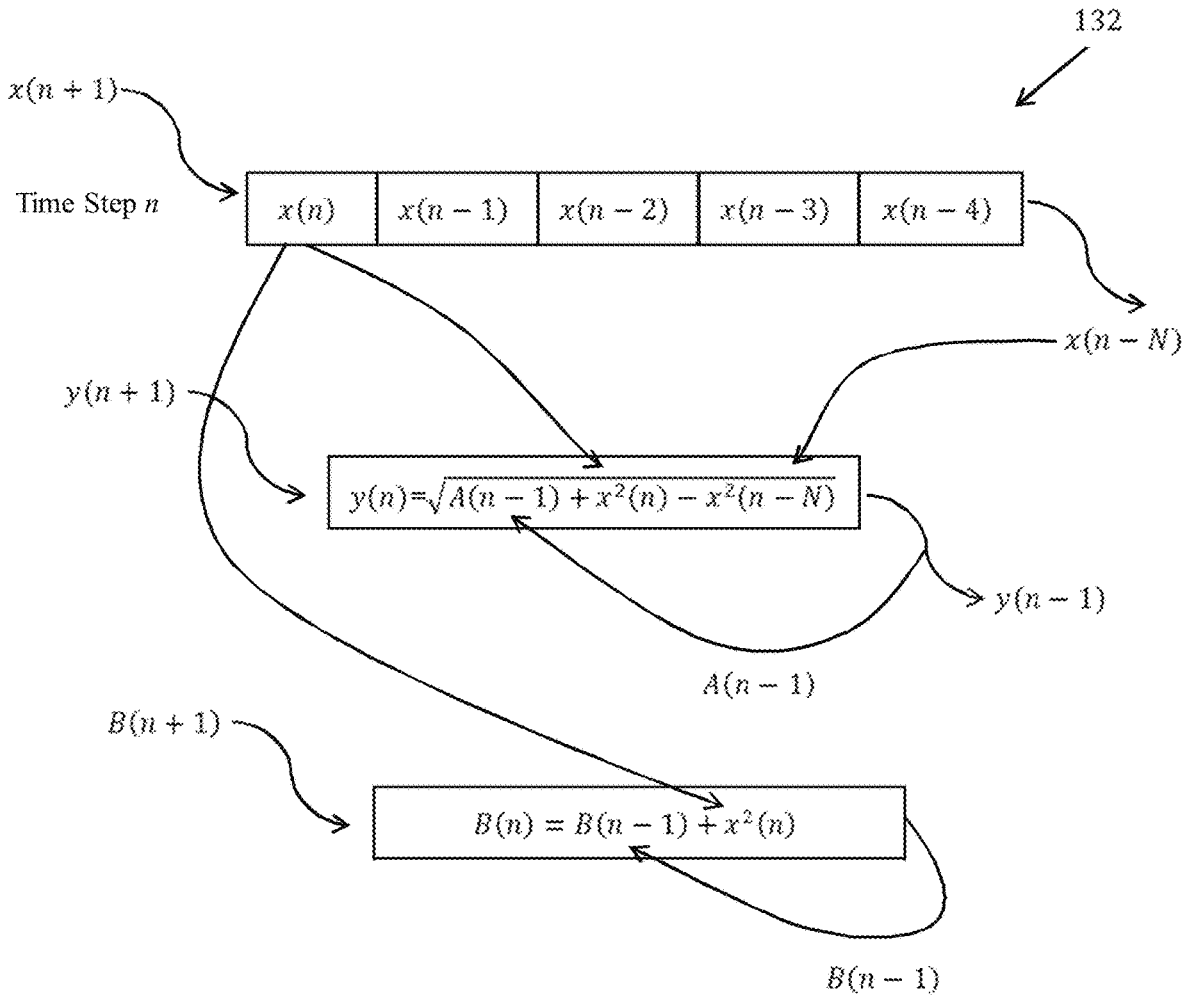
FIG. 9 is a diagrammatic representation of a hybrid recursive norm calculation with error correction according to an embodiment.

The recursive norm calculation, described above and depicted in FIG. 6, however, experiences accumulating rounding errors, when implemented in a floating-point processor, as the result of using the large previously-calculated value as part of a recursive calculation. Consequently, the result y(n) will slowly deviate from the correct value. Indeed, the accumulating rounding errors may come to dominate the resulty(n). An example of this problem is shown in FIG. 8, which compares error (the y-axis) to sample or time step (the x-axis) for an example 200-value buffer. Line 802, which is the result of the recursive method, shows the error between the recursive method of FIG. 6 and the typical norm-calculation method of FIG. 5 and the nature of the random walk of the error that can potentially grow unbounded over time.

This may be corrected in one of a couple of ways. For example, perhaps most simply, the result y(n) may be periodically recalculated according to equation (5), which then replaces the value of y(n) that had been calculated recursively (that is according to equations (6) and (7)) to correct y(n). Ideally, this would be performed often enough to avoid the error dominating the value or drifting away from the point that norm calculation is useful for its intended result—e.g., noise-cancellation.

But this correction method involves performing a very intensive calculation at periodic intervals. It is thus not efficient and consumes processing resources in a temporally asymmetric manner. Accordingly, the value of y(n) may be replaced with the correct value of the norm calculation according to a different method, referred to in this disclosure as the hybrid recursive norm calculation, and which is shown in diagrammatically in FIG. 9. According to the hybrid recursive norm calculation, a second calculation may be calculated in parallel with the recursive calculation. The second calculation, shown as B(n), calculates a running total of squared and summed input values for each received input value of x(n) until the number of values squared and summed equals the length of buffer 132, at which point the value B (n) (after being square-rooted) will equal the correct value of the norm calculation.

This may be demonstrated formally, as follows:

$$B(n)=B(n-1)+x^2(n) \tag{8}$$

where B(0)=0. At each time step, the newly-received value x(n) is squared and summed with the previous value of B(n), B(n−1). Thus, equation (8) represents a running sum of squared input values, where the new squared input value $x^2(n)$ is added at each time step. Once B(n) has been calculated N times (e.g., mod(n, N)≠0), the value of B(n) will equal the correct value of the summed and squared values currently stored in buffer 132. In other words, B(n) will equal the correct value of A(n), at which point the current value of A(n), calculated according to the recursive norm calculation (equation (6)), is replaced with value of B(n). With A(n) now equaling the correct value without rounding errors, y(n) will also be corrected. Once the value of A(n) is set to B(n), the value of B(n) is zeroed and the process is begun again. In this way, the result y(n) will be corrected every N samples, and thus the effect of accumulating rounding errors is minimized in a more computationally efficient way.

Figure 10:
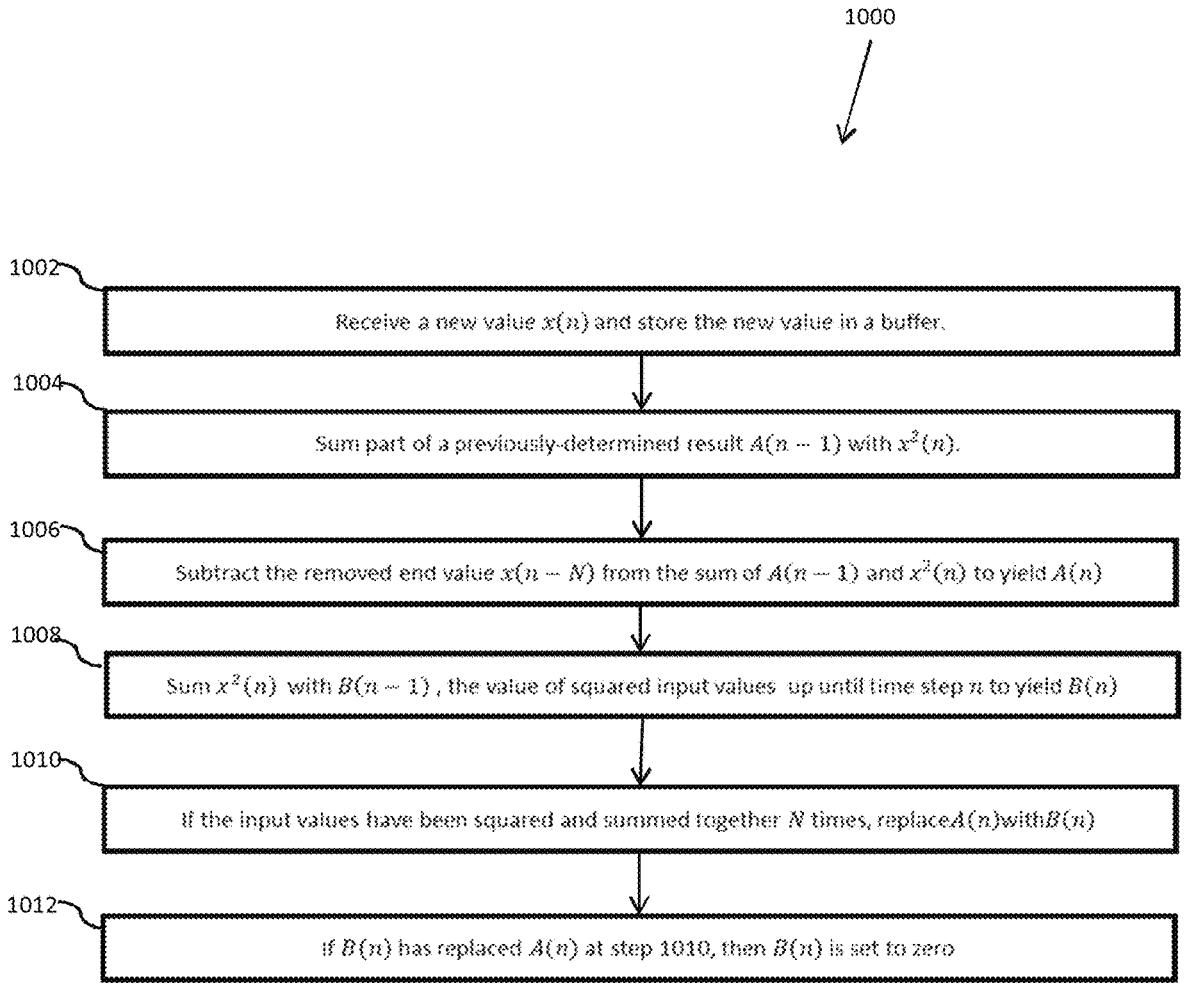
FIG. 10 is a flowchart of a recursive norm calculation method with error correction according to an embodiment.

Method 700, amended to include the hybrid recursive norm calculation, shown as method 1000 in FIG. 10. Steps 1002-1006 thus mirror the steps of 702-706, because the recursive norm calculation occurs in the same way. At step 1008, the newly received value x(n) is squared, (thus yielding $x^2(n)$) and added to a sumB(n−1), stored in memory, which represents the squared input values summed together up until time step n. At step 1010, if the input values have been squared and summed together N times, the squared and summed value (B(n)) replaces the recursive squared and summed value (A(n)) determined in step 1006. At step 1012, if B (n) has replaced A(n) at step 1010, then B(n) is set to zero.

Returning to FIG. 8, this hybrid recursive norm calculation yields the substantially straight line 804 that hovers around zero, and does so using fewer operations per time step than a correction method requiring the calculation of the entire correct value in a single time step. The error of the hybrid method is returned to zero with respect to the typical norm-calculation every N samples when B(n) is assigned to A(n). This disclosure thus describes a method of calculating a norm that is more efficient than previous methods, while maintaining accuracy within acceptable standards, thus improving the functioning of a computer.

The above-described recursive norm calculations, and recursive methods with corrections (including the hybrid recursive norm calculation) all function to deliver a norm calculation which may be used to update an adaptive filter, such as $W_{adapt}$ 126. The updated adaptive filter may then be used to deliver an updated noise-cancellation signal to actuator 110, which transduces the noise-cancellation signal to product a noise-cancellation audio signal that substantially cancels undesired noise in a cancellation zone.

It should be understood that, although the above has been described in connection with a noise-cancellation algorithm, the methods may be used in connection with norm calculations in any contexts. It should also be understood that the above-described noise-cancellation system 100 is merely provided as an example, and any noise-cancellation system (e.g., feedforward or feedback systems) calculating a norm to update an adaptive filter may be used.

The functionality described herein, or portions thereof, and its various modifications (hereinafter "the functions") can be implemented, at least in part, via a computer program product, e.g., a computer program tangibly embodied in an information carrier, such as one or more non-transitory machine-readable media or storage device, for execution by, or to control the operation of, one or more data processing apparatus, e.g., a programmable processor, a computer, multiple computers, and/or programmable logic components.

A computer program can be written in any form of programming language, including compiled or interpreted languages, and it can be deployed in any form, including as a stand-alone program or as a module, component, subroutine, or other unit suitable for use in a computing environment. A computer program can be deployed to be executed on one computer or on multiple computers at one site or distributed across multiple sites and interconnected by a network.

Actions associated with implementing all or part of the functions can be performed by one or more programmable processors executing one or more computer programs to perform the functions of the calibration process. All or part of the functions can be implemented as, special purpose logic circuitry, e.g., an FPGA and/or an ASIC (application-specific integrated circuit).

Processors suitable for the execution of a computer program include, by way of example, both general and special purpose microprocessors, and any one or more processors of any kind of digital computer. Generally, a processor will receive instructions and data from a read-only memory or a random access memory or both. Components of a computer include a processor for executing instructions and one or more memory devices for storing instructions and data.

While several inventive embodiments have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the inventive embodiments described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the inventive teachings is/are used. Those skilled in the art will recognize, or be able to ascertain using no more than routine experimentation, many equivalents to the specific inventive embodiments described herein. It is, therefore, to be understood that the foregoing embodiments are presented by way of example only and that, within the scope of the appended claims and equivalents thereto, inventive embodiments may be practiced otherwise than as specifically described and claimed. Inventive embodiments of the present disclosure are directed to each individual feature, system, article, material, and/or method described herein. In addition, any combination of two or more such features, systems, articles, materials, and/or methods, if such features, systems, articles, materials, and/or methods are not mutually inconsistent, is included within the inventive scope of the present disclosure.

What is claimed is:

1. A noise-cancellation method, comprising the steps of:

receiving a value from a noise sensor at a time step;

storing the received value in a buffer, the buffer having a length, the buffer further storing a number of additional values, wherein an end value is removed from the buffer to accommodate the received value;

providing a previously-computed result, wherein the previously-computed result represents a sum of the square of the values stored in the buffer at a previous time step;

performing one of:

(i) adding a square of the received value to the previously-computed result and subtracting a square of the end value from the sum of the received value and the previously-computed result in order to yield a newly-computed result; or (ii) subtracting a square of the end value from the previously-computed result and adding a square of the received value to the result of subtracting the square of the end value from the previously-computed result in order to yield a newly-computed result;

updating a plurality of coefficients of an adaptive filter according to, in part, the value of the newly-computed result;

generating with the adaptive filter a noise-cancelling signal using the updated plurality of coefficients; and providing the noise-cancellation signal to an actuator for transduction of a noise-cancellation audio signal based on the noise-cancellation signal, the noise-cancellation audio signal destructively interfering with an undesired noise signal in a noise-cancellation zone.

2. The method of claim 1, further comprising the step of finding a square root of the newly-computed result to yield a norm calculation, wherein the step of updating the plurality of coefficients is based in part on the norm calculation.

3. The method of claim 1, further comprising the steps of: adding the square of the received value to a running sum of squared received values to yield a current running sum of squared received values; and replacing the newly-computed result with the current running sum of squared received values if the current running sum of squared received values is the result of summing together a number of squared values equal to the length of the buffer.

4. The method of claim 3, further comprising the step of setting the current running sum of squared received values to zero after replacing the newly-computed result with the current running sum of square received values.

5. The method of claim 1, further comprising the step of, during the time step, summing the square of the values stored in the buffer to yield a corrective value and replacing the newly-computed result with the corrective value.

6. The method of claim 1, wherein the received value comprises a plurality of received values and the end value comprises a plurality of end values, wherein the number of the plurality of received values and the number of the plurality of end values is the same.

7. The method of claim 1, wherein steps (i) and (ii) are performed before the step of storing the value in the buffer.

8. Program code stored on a non-transitory storage medium that, when executed by a processor, comprises the steps of:

receiving a value from a noise sensor at a time step;

storing the received value in a buffer, the buffer having a length, the buffer further storing a number of additional values, wherein an end value is removed from the buffer to accommodate the received value;

providing a previously-computed result, wherein the previously-computed result represents a sum of the square of the values stored in the buffer at a previous time step;

performing one of:

(i) adding a square of the received value to the previously-computed result and subtracting a square of the end value from the sum of the received value and the previously-computed result in order to yield a newly-computed result; or (ii) subtracting a square of the end value from the previously-computed result and adding a square of the received value to the result of subtracting the square of the end value from the previously-computed result in order to yield a newly-computed result;

updating a plurality of coefficients of an adaptive filter according to, in part, the value of the newly-computed result;

generating with the adaptive filter a noise-cancelling signal using the updated plurality of coefficients; and outputting the noise-cancellation signal to an actuator for transduction of a noise-cancellation audio signal based on the noise-cancellation signal, the noise-cancellation audio signal destructively interfering with an undesired noise signal in a noise-cancellation zone.

9. The program code of claim 8, further comprising the step of finding a square root of the newly-computed result to yield a norm calculation, wherein the step of updating the plurality of coefficients is based in part on the norm calculation.

10. The program code of claim 8, further comprising the steps of: adding the square of the received value to a running sum of squared received values to yield a current running sum of squared received values; and replacing the newly-computed result with the current running sum of squared received values if the current running sum of squared received values is the result of summing together a number of squared values equal to the length of the buffer.

11. The program code of claim 10, further comprising the step of setting the current running sum of squared received values to zero after replacing the newly-computed result with the current running sum of square received values.

12. The program code of claim 8, further comprising the step of, during the time step, summing the square of the values stored in the buffer to yield a corrective value and replacing the newly-computed result with the corrective value.

13. The program code of claim 8, wherein the received value comprises a plurality of received values and the end value comprises a plurality of end values, wherein the number of the plurality of received values and the number of the plurality of end values is the same.

14. The program code of claim 8, wherein steps (i) and (ii) are performed before the step of storing the value in the buffer.

15. A noise-cancellation system, comprising:

a noise-cancellation filter including a plurality of coefficients configured to generate a noise-cancellation signal based on the plurality of coefficients;

an actuator configured to receive the noise-cancellation signal and to transduce a noise-cancellation audio signal based on the noise-cancellation signal, the noise-cancellation signal destructively interfering with an undesired noise signal in a noise-cancellation zone;

an error sensor configured to output an error sensor signal having a value at a time step; the error sensor signal being representative of residual undesired noise in the noise-cancellation zone;

an adaptive processing module configured to:

store the value in a buffer, the buffer having a length, the buffer further storing a number of additional values, wherein an end value is removed from the buffer to accommodate the value;

provide a previously-computed result, wherein the previously-computed result represents a sum of the square of the values stored in the buffer at a previous time step;

perform one of:

(i) adding a square of the value to the previously-computed result and subtracting a square of the end value from the sum of the value and the previously-computed result in order to yield a newly-computed result; or (ii) subtracting a square of the end value from the previously-computed result and adding a square of the value to the result of subtracting the square of the end value from the previously-computed result in order to yield a newly-computed result;

update the plurality of coefficients of the adaptive filter according to, in part, the value of the newly-computed result;

wherein the noise-cancellation filter is configured to generate an updated noise-cancelling signal based on the updated plurality of coefficients, the actuator transducing an updated noise-cancellation audio signal based on the updated noise-cancellation signal, the updated noise-cancellation audio signal destructively interfering with an undesired noise signal in a noise-cancellation zone.

16. The noise-cancellation system of claim 15, wherein the adaptive processing module is further configured to find a square root of the newly-computed result to yield a norm calculation, wherein updating the plurality of coefficients is based in part on the norm calculation.

17. The noise-cancellation system of claim 15, wherein the adaptive processing module is further configured to: add the square of the received value to a running sum of squared received values to yield a current running sum of squared received values; and replace the newly-computed result with the current running sum of squared received values if the current running sum of squared received values is the result of summing together a number of squared values equal to the length of the buffer.

18. The noise-cancellation system of claim 17, wherein the adaptive processing module is further configured to set the current running sum of squared received values to zero after replacing the newly-computed result with the current running sum of square received values.

19. The noise-cancellation system of claim 15, wherein the adaptive processing module is further configured to: during the time step, sum the square of the values stored in the buffer to yield a corrective value and replace the newly-computed result with the corrective value.

20. The noise-cancellation system of claim 15, wherein the received value comprises a plurality of values and the end value comprises a plurality of end values, wherein the number of the plurality of values and the number of the plurality of end values is the same.

* * * * *